US005499862A

United States Patent [19]

Janisch

[11] Patent Number: 5,499,862

[45] Date of Patent: Mar. 19, 1996

[54] TURNTABLE

[75] Inventor: Klaus Janisch, Isny, Germany

[73] Assignee: Schmidt & Lenhardt GmbH & Co. oHG, Isny, Germany

[21] Appl. No.: 260,117

[22] Filed: Jun. 15, 1994

[30] Foreign Application Priority Data

Jun. 30, 1993 [EP] European Pat. Off. ..... 93110395

[51] Int. Cl.[6] ..... A61G 7/10

[52] U.S. Cl. ..... 297/311; 297/240; 297/337

[58] Field of Search ..... 297/311, 240, 297/337, 344.24, 242, 344.21, 256.12, 452.48, 452.55, 452.57, 440.11, 440.22; 5/81.1, 402, 403, 404, 411

[56] References Cited

U.S. PATENT DOCUMENTS 5,000,513 3/1991 Schmidt ..... 297/240 X 5,390,378 2/1995 Janisch ..... 15/81.1

5,390,978 2/1995 Janisch ..... 297/240

FOREIGN PATENT DOCUMENTS 210710 2/1987 European Pat. Off. ..... 297/440.22

*Primary Examiner*—Laurie K. Cranmer

*Attorney, Agent, or Firm*—Notaro & Michalos

[57] ABSTRACT

A top plate (12) with a padded cushion (18) is pivotably mounted on a bottom plate (16) . The padded cushion (18) is fixed in position on the top plate (12) by an integral rigid retaining ring ( 20) , with inner beading (34) of the retaining ring (20) extending in a clamping fashion beneath outer beading (26) of the top plate (12). An annular groove (22) close to the outer edge of the top plate (12) means that the remaining annular wall (24) with the marginal beading (26) is only connected to the top plate (12) via a thin bridge, said bridge constituting an articulation zone (28), so that, when the retaining ring (20) is lifted off, the annular wall (24) functions as a flexible tongue and can be moved elastically inwards.

10 Claims, 3 Drawing Sheets

TURNTABLE

BACKGROUND OF THE INVENTION

The invention relates to a turntable serving as a seat surface for handicapped persons, comprising a bottom plate, a top plate pivotably mounted thereon, a padded cushion disposed centrally on said top plate, and an integral retaining ring with a circular outline, releasably fixed to said top plate and overlapping said padded cushion at its circumferential edge, gripping the top and bottom of the outer edge of said top plate like a hook and resting thereon so as to clamp it.

A turntable is known from European Patent EP 0 364 746, which consists of a plurality of individual ring segments arranged side by side circumferentially and having locking pins on the bottom which are releasably engaged in corresponding holes in the rotatable top plate. Thanks to this construction in segments, the retaining ring is inexpensive to manufacture. On the other hand, it is somewhat awkward to assemble and dismantle, and also the appearance of the retaining ring is not always satisfactory, because of the unavoidable tolerances, which give rise to visible radial gaps between the individual segments of the retaining ring. While this known retaining ring does overlap the outer edge of the top plate, it nevertheless lies flush with said outer edge at the bottom, so that it does not grip the underside of the top plate.

SUMMARY OF THE INVENTION

The object of the invention is to design the turntable of the type described at the beginning in such a way that, while preserving the integral form of the retaining ring, the retaining ring does not need to be twisted during assembly and dismantling, and to simplify the top plate with regard to its outline.

This problem is solved in a turntable of the type described at the beginning in that, closely adjacent to the outer edge of the top plate, an annular groove is provided in said top plate, which extends along at least part of the periphery and terminates at one of the two surfaces of the top plate, and that a thin-walled flexible zone is formed between the bottom of said annular groove and the adjacent surface of the top plate, and an annular wall is formed between the annular groove and the outer peripheral surface of the top plate, which, by the exertion of force radially inwards, can be displaced in this direction with a resilient restoring effect.

The retaining ring can be manufactured from the same rigid plastic material as the top plate. Thanks to the annular groove provided in accordance with the invention, the edge of the top plate, which is otherwise solid and whose shape it is impossible to alter, is given an elastically flexible annular wall. Since only a thin bridge is left between the bottom of the annular groove and the adjacent surface of the top plate, said bridge serves as an articulation and makes it possible to shift the position of the end of the annular wall facing downwards, even if a rigid plastic material is used for the top plate.

The annular groove can terminate in the upper surface, i.e. the top of the top plate, or it can start from the lower surface, i.e. the bottom of the top plate. In both cases, when the inner edge of the retaining ring, which extends beneath the outer edge of the annular wall of the top plate, is pressed upwards, this causes the annular wall to be displaced into the annular groove, thus causing the inner edge of the retaining ring to be released from the outer edge of the top plate, so that the retaining ring can be removed upwardly from the top plate. The bottom plate can be circular in outline, like the top plate, as in DE-B-0364 746, or it can also be elongate, as in EP-A-(Application No. 93104198.2), wherein the top plate is provided with a slide on the bottom, which is displaceable in a longitudinal runner in the bottom plate.

Although it falls within the scope of the invention to design the deformable annular wall of the top plate with a continuous circumference, one preferred embodiment nevertheless consists in there being regularly spaced recesses in the outer edge of the top plate, with the annular wall being interrupted in the region of these recesses. The retaining ring is thus retained only in the circumferentially spaced annular wall portions of the top plate. Spaced annular wall portions of this kind are easier to bend than a continuous annular wall running about the entire circumference.

The new turntable is easier to manufacture, since rigid material can be used for the retaining ring and the top plate, so that there is no longer any need to provide the top plate with a non-circular outline. The rigid, non-deformable retaining ring facilitates assembly in that it is no longer possible for the padded cushion to be displaced.

DETAILED DESCRIPTION

Figure 1:
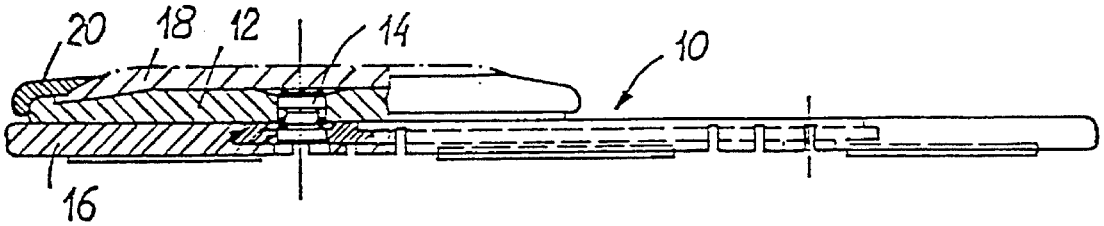
FIG. 1 shows the basic structure of a turntable with a rotatable and, in addition, longitudinally displaceable rotating plate, partially in section.
Figure 2:
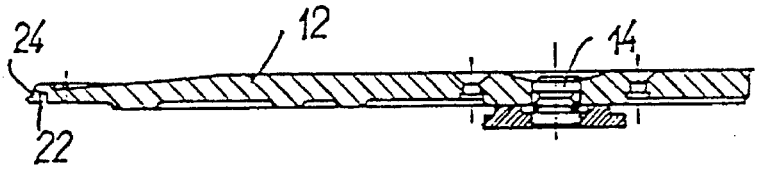
FIG. 2 is a sectional view through the new embodiment of the top plate.

The turntable 10 shown in FIG. 1 consists of the following principal components, viz. a top plate 12 rotatably mounted on a bottom plate 16 by means of a central bearing journal 14, and a padded cushion 18, the outer edge of which is fixed by a retaining ring 20 which for its part overlaps the outer edge of the top plate 12 so as to clamp it. The bottom plate 16 is elongate in shape according to FIG. 1 and has a longitudinal slide runner guiding a slide on the bottom side of the top plate 12. This elongate shape of the bottom plate 16 makes it possible to move patients or handicapped persons in a bed to the side of the bed, and there to rotate them into an alighting position. Similarly, it is advantageous to use this turntable in combination with bathtub lifting devices in such a way that, here too, it easily becomes possible to transfer the handicapped person from the edge of the bathtub to the seat surface of the lifting device and vice versa.

As an alternative to the illustration shown in FIG. 1, however, the bottom plate 16 can also be circular in outline.

An essential feature in use is that the turntable 10 can be dismantled quickly without the need for tools, so that the individual parts can be cleaned and after that the unit can be re-assembled just as quickly and easily.

As can be seen from FIGS. 3 and 4 in particular, the top plate 12 has an annular groove 22 closely adjacent to its outer edge, though, as will be explained below, this is interrupted by recesses, so that circumferentially spaced annular groove portions are formed. Between this annular groove 22 and the outer edge of the top plate 12, an annular wall 24 is formed, with outwardly projecting marginal beading 26 on the lower edge of said annular wall. Only a thin bridge is left between the bottom of the annular groove 22 and the top surface of the top plate 12, said bridge constituting an articulation zone 28 for the annular wall 24. The marginal beading 26 of the annular wall 24 is delimited by two wedge-shaped conical surfaces, namely a supporting surface 30 at the bottom and an operating surface 32 at the top.

The retaining ring 20 has inner marginal beading 34 at the bottom, the internal diameter of which corresponds to the external diameter of the annular wall 24. Said inner marginal beading 34 of the retaining ring 20 likewise has two conical delimiting surfaces, viz. a retaining surface 36 at the top and an operating surface 38 at the bottom. The angle of conicity between these marginal beading surfaces is approximately 90°, so that, in axial section, these surfaces are, respectively, 45° to the plane of rotation of the rotating plate 12.

Figure 4:
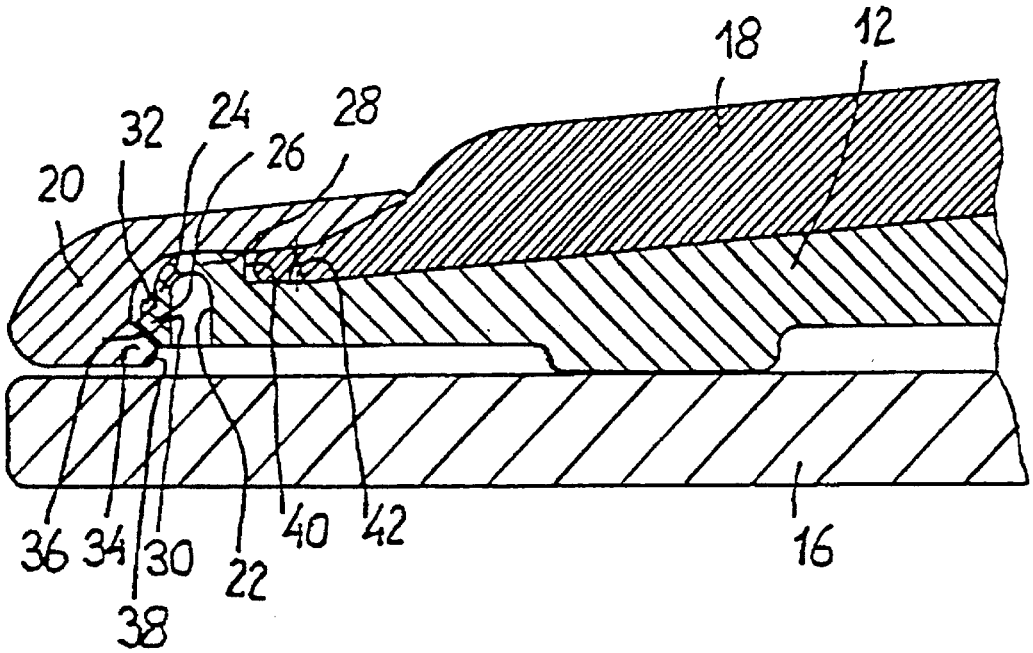
FIG. 4 is a sectional view in the edge portion of the turntable, approximately along the line 4—4 in FIG. 3.

In the assembled position as per FIG. 4, the inner marginal beading 34 of the retaining ring 20 extends beneath the outer marginal beading 26 of the annular wall 24, with the retaining surface 36 resting over a large area on the supporting surface 30 of the outer marginal beading 26. The relative dimensions between the top plate 12 and the retaining ring 20 are chosen such that the retaining ring 20 rests directly on the outer portion of the top surface of the top plate 12 and the marginal beading 34 of the retaining ring 20 clamps said retaining ring and holds it firmly against the marginal beading 26 of the top plate 12. In order to dismantle the turntable 10, the retaining ring 20 is lifted off the bottom plate 16 by its outer edge. In the process, the wedge effect means that the inner marginal beading 34 of the retaining ring 20 causes the annular wall 24 to swing inwards, with the deformation taking place essentially in the articulation zone 28 and the adjacent portion of the annular wall 24. The marginal beading 26 is displaced, with its annular wall 24, towards the centre of the turntable, up to the internal diameter of the marginal beading 34 of the retaining ring 20, after which the connection between the retaining ring 20 and the rotating plate 12 is released over a certain portion of the circumference. The same is done in the adjacent portions of the turntable. The retaining ring 20 can then be removed upwardly, after which the padded cushion 18 is revealed and can likewise be removed from the top plate 12.

In the course of the subsequent re-assembly, after the retaining ring 20 is fitted, the wedge-shaped operating surface 38 on the marginal beading 34 comes into contact over a wide area with the corresponding operating surface 32 of the outer marginal beading 26 on the annular wall 24. When the retaining ring 20 is pressed downwards, the operating surface 38 causes the annular wall 24 to swing inwards until the outer edge of the marginal beading 26 comes to rest on the internal radius of the inner marginal beading 34 of the retaining ring 20. After that, the annular wall 24 snaps back outwards, causing the supporting surface 30 to slide along the retaining surface 36 and, when the parts reach their final position, these two surfaces are held clamped together.

In the sample embodiment, the annular groove 22 is shown open at the bottom. In an alternative embodiment, the annular groove 22 could also start from the top surface of the top plate 12, so that the flexible zone of the annular wall 24 would then be disposed on the bottom side. The outer marginal beading 26 would then be located at the free upper end of the annular wall 24.

The top plate 12 has a shoulder 40 at a certain distance from its outer edge, thus causing an annular gap to form between the top surface of the top plate 12 and the retaining ring 20, the outer edge of the padded cushion 18 engaging in said annular gap. In the region of this annular gap, there are a number of spikes arranged in a ring and protruding upwards from the top surface of the top plate 12 to a height that is only slightly less than the width of the gap between the top plate 12 and the retaining ring 20. These spikes serve to fix the padded cushion 18 in a positive fit. Spikes of this kind are known from the prior art, but were in the past provided on the retaining ring 20, with the disadvantage that it was possible for the padded cushion 18 to be displaced during assembly of the retaining ring 20. The arrangement of the spikes 42 on the top plate 12 ensures that the padded cushion 18 is securely fixed to the top plate 12 even before the retaining ring 20 is placed on top, so that there is no possibility of its being subsequently displaced by the retaining ring 20 when it is clamped on.

Figure 3:
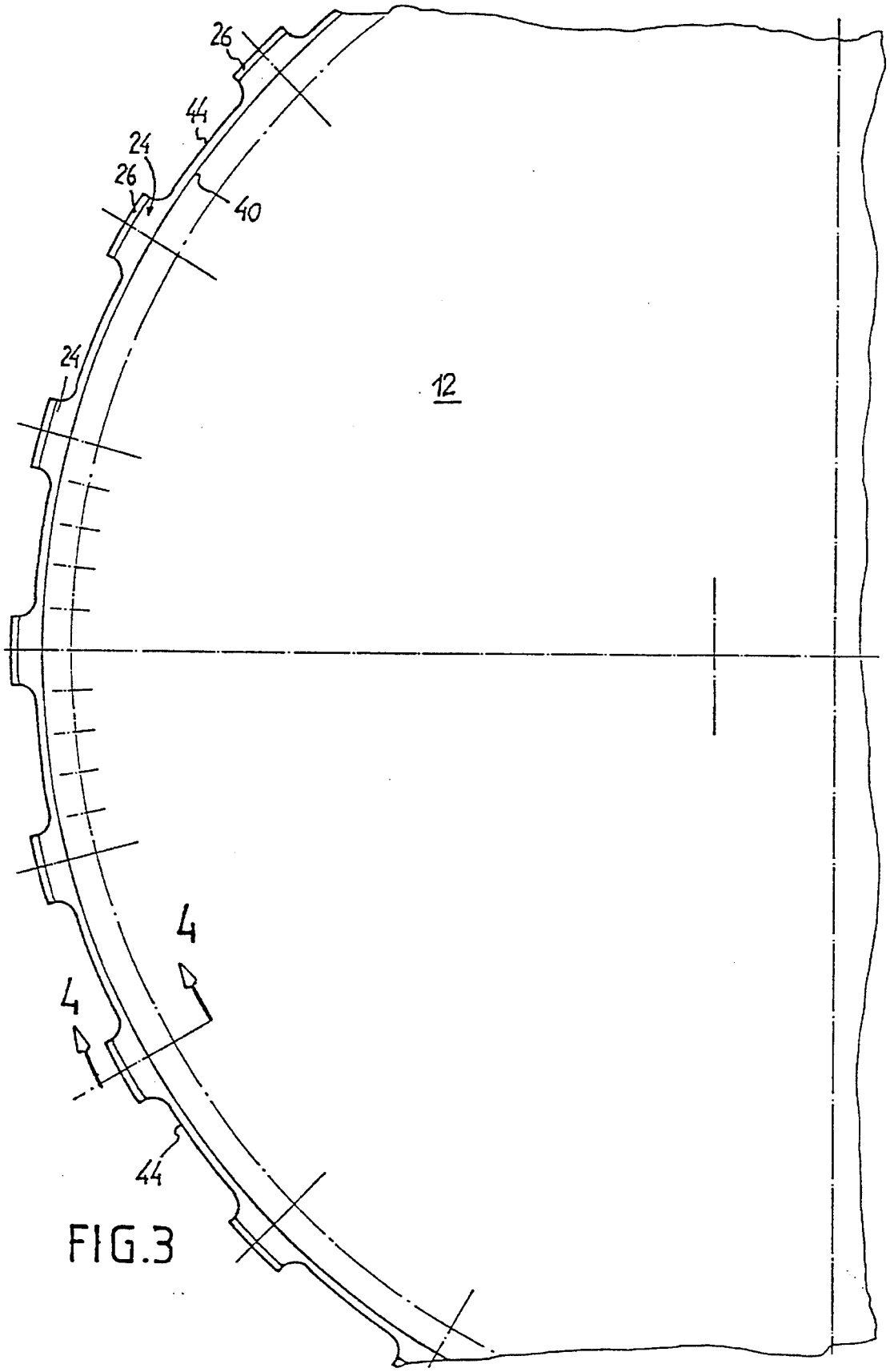
FIG. 3 is a plan view of a section of the top plate.

It is apparent from FIG. 3 that the annular groove 22 does not extend around the full circumference of the top plate 12, and that the latter has marginal recesses 44 in the regions of which the annular wall 24 and the adjacent articulation zone 28 are interrupted. The depth of the marginal recess 44 is preferably the same as the distance of the outer edge of the marginal beading 26 from the inner annular surface of the annular groove 22. The annular wall 24 between each pair of recesses 44 thus forms a flexible tongue. There are 24 such tongues disposed evenly around the circumference of the top plate 12. The circumferential length of such a flexible tongue is smaller than that of a recess 44. A ratio of 1:2 has proven favourable in practice, i.e. the circumferential length of a portion of annular wall 24 is about half as great as that of a marginal recess 44.

I claim:

1. Turntable serving as a seat surface for handicapped persons, comprising a bottom plate (16), a top plate (12) pivotably mounted thereon, a padded cushion (18) disposed centrally on said top plate (12), and an integral retaining ring (20) with a circular outline, releasably fixed to said top plate (12) and overlapping said padded cushion (18) at its circumferential edge, gripping a top and a bottom of an outer edge of said top plate (12) and resting thereon so as to clamp it, characterised in that, closely adjacent to the outer edge of the top plate (12), an annular groove (22) is provided in said top plate (12), which extends along at least part of the periphery and terminates at one of the two surfaces of the top plate (12), defining the top side and the bottom side, and that a thin-walled flexible zone (28) is formed between a bottom of said annular groove (22) and an adjacent surface of the top plate (12), and an annular wall (24) is formed between the annular groove (22) and an outer peripheral surface of the top plate (12), which, by the exertion of radially inward force, can be displaced in this direction with a resilient restoring effect.

2. Turntable as claimed in claim 1, characterized in that the surface that the annular groove (22) terminates at is the bottom surface of the top plate (12).

3. Turntable as claimed in claim 1, characterised in that the top plate (12) has regularly spaced marginal recesses (44) forming a plurality of regions in which the annular wall (24) is interrupted.

4. Turntable as claimed in claim 3, characterised in the circumferential length of each of the marginal recesses (44) is at least equal to that of the portion of annular wall (22) formed between each pair of marginal recesses (44).

5. Turntable as claimed in claim 4, characterised in that the circumferential length of each portion of annular wall (24) is approximately half as great as that of the marginal recess (44).

6. Turntable as claimed in claim 1, characterised in that the annular wall (24) has an inclined supporting surface (30) at a bottom, terminating at an outer circumferential surface of said annular wall (24), with an inner marginal beading (34) of the retaining ring (20) resting in a clamped manner on said supporting surface (30).

7. Turntable as claimed in claim 6, characterised in that the supporting surface ( 30 ) is formed on marginal beading (26) projecting outwardly from the annular wall (24).

8. Turntable as claimed in claim 7, characterised in that a top surface of the marginal beading (26) of the annular wall is formed as an inclined operating surface (32), rising inwardly from the outside.

9. Turntable as claimed in claim 6, characterised in that the top surface of the inner marginal beading (34) of the retaining ring (20) is formed as a retaining surface (36) sloping inwards from the outside, which rests over a region on the supporting surface (30) of the top plate (12), in a clamping fashion.

10. Turntable as claimed in claim 1, characterised in that, in a the region where the retaining ring (20) and padded cushion (18) overlap, the top plate (12) has a concentric arrangement of spikes (42) pointing upwards, the height of which is only slightly less than the size of a gap formed between the retaining ring (20) and the top surface of the top plate (12) for receiving the edge of the padded cushion (18).

* * * * *